United States Patent [19]

Schindler et al.

[11] Patent Number: 4,596,650

[45] Date of Patent: Jun. 24, 1986

[54] LIQUEFACTION OF SUB-BITUMINOUS COAL

[75] Inventors: Harvey D. Schindler, Fair Lawn; James M. Chen, Edison, both of N.J.

[73] Assignee: Lummus Crest, Inc., Bloomfield, N.J.

[21] Appl. No.: 590,175

[22] Filed: Mar. 16, 1984

[51] Int. Cl.[4] ..... C10G 1/00

[52] U.S. Cl. ..... 208/409; 208/417; 208/418

[58] Field of Search ..... 208/8 LE, 10

[56] References Cited

U.S. PATENT DOCUMENTS

| | | | |
|---|---|---|---|
| 3,575,847 | 4/1971 | Sprow et al. | 208/10 |
| 3,671,418 | 6/1972 | Gatsis | 208/10 |
| 4,045,329 | 8/1977 | Johanson et al. | 208/10 |
| 4,110,192 | 8/1978 | Hildebrand et al. | 208/8 LE |
| 4,251,346 | 2/1981 | Dry et al. | 208/10 |
| 4,300,996 | 11/1981 | Kuehler | 208/10 |
| 4,326,946 | 4/1982 | Chikata et al. | 208/8 LE |
| 4,332,666 | 6/1982 | Baumann et al. | 208/8 LE |
| 4,347,117 | 8/1982 | Bauman et al. | 208/8 LE |
| 4,371,727 | 2/1983 | Gavin | 208/10 |
| 4,411,767 | 10/1983 | Garg | 208/8 LE |
| 4,452,688 | 6/1984 | Mitchell et al. | 208/10 |
| 4,476,009 | 10/1984 | Kuhlmann et al. | 208/8 LE |

*Primary Examiner*—D. E. Gantz
*Assistant Examiner*—Lance Johnson
*Attorney, Agent, or Firm*—Elliot M. Olstein

[57] ABSTRACT

Sub-bituminous coal is directly liquefied in two stages by use of a liquefaction solvent containing insoluble material as well as 850° F.+ material and 850° F.− material derived from the second stage, and controlled temperature and conversion in the second stage. The process is in hydrogen balance.

17 Claims, 2 Drawing Figures

LIQUEFACTION OF SUB-BITUMINOUS COAL

Figure 1:
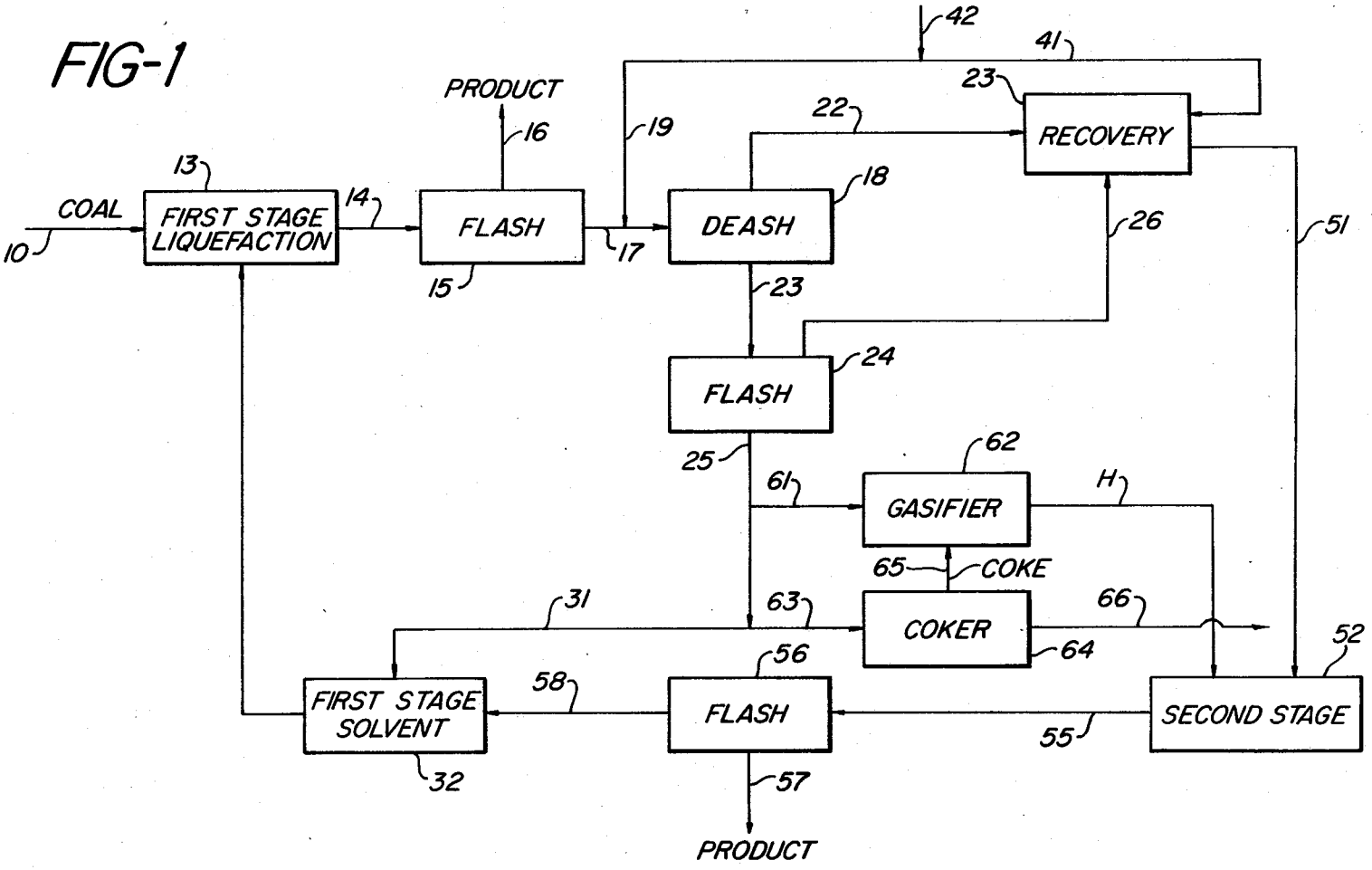

The Government of the U.S. of America has rights in this invention pursuant to Contract No. DEAC 22-82PC50021 awarded by the U.S. Department of Energy.

The present invention relates to the liquefaction of sub-bituminous coal.

Sub-bituminous coals have been considered poor feeds for direct liquefaction processes as a result of the low reactivity of such coals. In particular, in attempting to liquefy sub-bituminous coals by direct liquefaction processes, in order to obtain conversions comparable to those obtained with bituminous coals, reaction conditions had to be more severe, which resulted in high gas yields that necessitated excessive hydrogen consumption. In addition, prior attempts to directly liquefy sub-bituminous coals have resulted in a hydrogen imbalance, whereby supplemental coal must be gasified to produce sufficient hydrogen for satisfying the hydrogen requirements for liquefaction. As a result, the net yield of distillate products, based on all the coal feed (the coal used in the liquefaction and that used in the gasification to generate hydrogen) has been low. Accordingly, in general, attempts to convert sub-bituminous coal to liquid products by a direct liquefaction process have not been successful.

The present invention is directed to a new and improved process for producing liquid products from sub-bituminous coal by a direct liquefaction process.

More particularly, in accordance with one aspect of the present invention, sub-bituminous coal is liquefied by a direct liquefaction process which employs two reaction stages. The first stage comprises a thermal liquefaction in the presence of a liquefaction solvent and the second stage comprises hydrogenation of first stage material at controlled conditions. The liquefaction solvent employed in the first thermal liquefaction stage is formulated from materials recovered from the second stage, as well as insoluble material derived from the coal feed (ash, undissolved coal, etc.).

Applicant has found that by employing the insoluble material derived from the coal and materials derived from the second stage for formulating the liquefaction solvent, in combination with controlled conditions in the second stage, sub-bituminous coal can be effectively converted to valuable products by a direct liquefaction process.

The liquefaction solvent employed in the first stage is formulated by use of 850° F.+ material from the second stage (generally all of such material, whereby there is no net make of 850° F.+ material) as well as 850° F.− material from the second stage, with such 850° F.− material generally having an initial boiling point of at least 500° F.; however, in some cases, the initial boiling point may be as high as 650° F. The liquefaction solvent also includes a pumpable stream of insoluble material (ash, undissolved coal, etc.), which includes 850° F.+ liquid, which is recovered from either the first stage or the second stage depending on the point in the process in which insoluble material is separated from product; i.e., either between the first and second stages or subsequent to the second stage.

The term 850° F.− material as used herein refers to material derived from the coal, which generally has an initial boiling point of at least 500° F., and which does not boil above 850° F., whereas the 850° F.+ material, is the full range of material, derived from the coal, except for insoluble material, and which boils above 850° F.

In general, the liquefaction solvent for the first stage is comprised of from about 5% to 10% of insoluble material, and at least 45%, and most generally at least 50% of 850° F.− material, with the remainder being 850° F.+ material. In general, the liquefaction solvent includes at least 20% of 850° F.+ material. The 850° F.− material which is employed in formulating the liquefaction solvent is preferably all derived from the second stage in that 850° F.− material from the second stage has better solvent properties; i.e. a higher ratio of hydrogen to carbon. In most cases, if 850° F.− material from the first stage is employed in formulating first stage solvent, such first stage 850° F.− material does not exceed 20% of the first stage solvent (850° F.− material from the first stage may comprise from 0% to 20% of the first stage solvent) and preferably, if used, does not exceed 5% to 15% of the solvent. It is to be understood that all percentages are by weight.

As to the 850° F.+ material used in formulating the first stage solvent, such 850° F.+ material may all be derived from the second stage, or in the case where deashing is effected between the first and second stage, a portion of the 850° F.+ material used in the solvent may be recovered fromthe first stage in that the insoluble material used in formulating the liquefaction solvent is preferably recovered as a pumpable stream which includes 850° F.+ material.

Applicant has surprisingly found that by controlling hydrogenation conditions in the second stage, it is possible to produce material in the second stage which is useful in formulating first stage liquefaction solvent. In general, in employing sub-bituminous coal as a feed, it was expected that liquids produced in the process would be high in paraffins and, therefore, would not be suitable for use in formulating a liquefaction solvent. Contrary to the expected belief, Applicant has found that by controlling second stage hydrogenation conditions, liquids derived from the sub-bituminous coal may be employed in formulating liquefaction solvent for the first stage, and such liquefaction solvent has sufficient hydrogen values so that the process may be maintained in hydrogen balance, without the necessity of gasifying coal so as to generate hydrogen for the process.

The second stage hydrogenation is controlled in a manner such that the temperature does not exceed about 700° F. In most cases, the temperature for the second stage hydrogenation is at least 650° F. In addition, second stage conversion, based on 850° F.+ material is controlled to at least 30% and no greater than 60% by weight.

Accordingly, by the use of controlled temperatures and conversions in the second stage as hereinbefore described, in combination with formulating first stage solvent from insoluble material recovered from the coal as well as both 850° F.− material, and 850° F.+ material produced in the second stage, sub-bituminous coal can be directly liquefied, in two stages, in a manner comparable to direct liquefaction of bituminous coal.

The first stage is generally operated at a temperature of from 800° F. to 875° F., and preferably at a temperature from 820° F. to 865° F. The first stage liquefaction, as a result of the hydrogen transfer properties of the solvent, can be operated with essentially no consumption of hydrogen; i.e., either essentially zero hydrogen partial pressure, or if there is a hydrogen partial pressure, essentially all of the hydrogen introduced into the first stage is recovered from the first stage effluent. It is to be understood, however, that higher hydrogen pressures could be used, even though it is possible to operate the first stage at essentially no hydrogen consumption. Thus for example, hydrogen partial pressures may be in the order of from 0 to 2000 psig. In general, gaseous hydrogen consumption in the first stage does not exceed 1%, by weight.

Reaction contact times in the first stage are generally somewhat longer than those employed in a first stage liquefaction of bituminous coal. In general, such longer reaction times may be accomplished by adding a soaker subsequent to the heater. In general, reaction times (at temperatures above 600° F.) are in the order of from 7 to 20 minutes.

The coal liquefaction solvent which is employed in the first stage, as hereinabove described, is employed in an amount such that the ratio of solvent to coal is in the order of from 1.2:1 to 3.0:1 on a weight basis. It is to be understood, however, that greater amounts could be employed, but in general, such greater amounts are not economically justified.

After the initial liquefaction, which includes both the heater, and preferably also a soaker, the first stage effluent may be treated to remove insoluble matter, sometimes referred to as deashing, although insoluble matter in addition to ash is removed from the effluent. In the alternative, such deashing may be accomplished after the second stage.

Although a variety of procedures may be employed for removing such insoluble material, in accordance with a preferred embodiment, the deashing is accomplished by the use of a liquid promoter having a characterization factor of at least 9.75, a 5 volume percent distillation temperature of at least about 250° F., and a 95 volume percent distillation temperature of at least about 350° F. and no greater than about 750° F., as described in U.S. Pat. No. 3,856,675. As described in such patent, a preferred promoter liquid is a kerosene fraction having a 5% and 95% volume distillation temperature of 425° F. and 500° F., respectively.

In accordance with the present invention, a pumpable 850° F.+ liquid, which includes insoluble material, is recovered from the deashing, and a portion of this liquid is employed in formulating liquefaction solvent for the first stage.

The feed to the second stage hydrogenation includes both 850° F.+ material, and 850° F.− material, and such feed may or may not include insoluble material derived from the coal. If any 850° F.− material from the first stage is to be used in formulating liquefaction solvent, such amount of 850° F.− material may be recovered prior to the second stage.

The second stage hydrogenation is operated at a controlled temperature, as hereinabove described, so as to provide liquid product which may be used in formulating first stage liquefaction solvent, as well as desired end product.

In addition to a controlled temperature in the order of from 650° F. to 700° F., the second stage is generally operated at a pressure in the order of from 1000 to 3000 psig, with contact times being in the order of from 0.3 to 3.0. In general, the second stage is operated in the presence of a hydrogenation catalyst of a type known in the art; for example, an oxide or sulfide of a Group VI and Group VII metal. For example, cobalt-molybdenum or nickel-molybdenum catalyst supported on a suitable support such as alumina or silica alumina may be employed. The contact time and temperatures are coordinated, as hereinabove described so as to achieve conversion of 850° F.+ material in the order of 30% to 60%.

In accordance with a preferred embodiment, such second stage hydrogenation is accomplished in an upflow ebullated bed, with such ebullated bed being of a type known in the art.

If deashing is not effected prior to the second stage, second stage effluent is treated to remove insoluble material prior to product recovery.

The effluent from the second stage which is free of insoluble material is then treated in a recovery zone to recover materials for use in formulating the liquefaction solvent (850° F.+ material and 850° F.− material having an initial boiling point of 500° F., and in some cases an initial boiling point of at least 650° F.), as well as net product; i.e., gases and $C_5$ to 850° F. materials. Thus, a portion of the 850° F.− material having an initial boiling point of at least 500° F. is recovered as product and a portion thereof is recovered for use in formulating first stage liquefaction solvent.

As a result of the use of lower reaction temperatures in the second stage, $C_1$ to $C_4$ gas yields are low, and the net product is relatively heavy, because of reduced thermal cracking of the 650° F. to 850° F. fraction. In particular, as a result of the reduced tempeature in the second stage, hydrogen consumption is reduced, and there is an efficient production of $C_5$ to 850° F. net product.

In accordance with a preferred embodiment, a pumpable stream of insoluble material derived from the coal (recovered by deashing subsequent to the first or second stage), in addition to being used for formulating first stage solvent, is employed for producing hydrogen for the process.

Applicant has surprisingly found that there is an excess hydrogen generating capacity (such material is capable of producing more hydrogen than is required for the process) and, therefore, a portion of such material may be upgraded to products other than hydrogen. For example, a portion of such material may be coked to produce additional distillates, and the resulting coke may be used in generating hydrogen for the process.

Thus, it is possible to maintain the process in hydrogen balance, i.e., without generating hydrogen from coal feed and/or obtaining hydrogen from an outside source.

Figure 2:
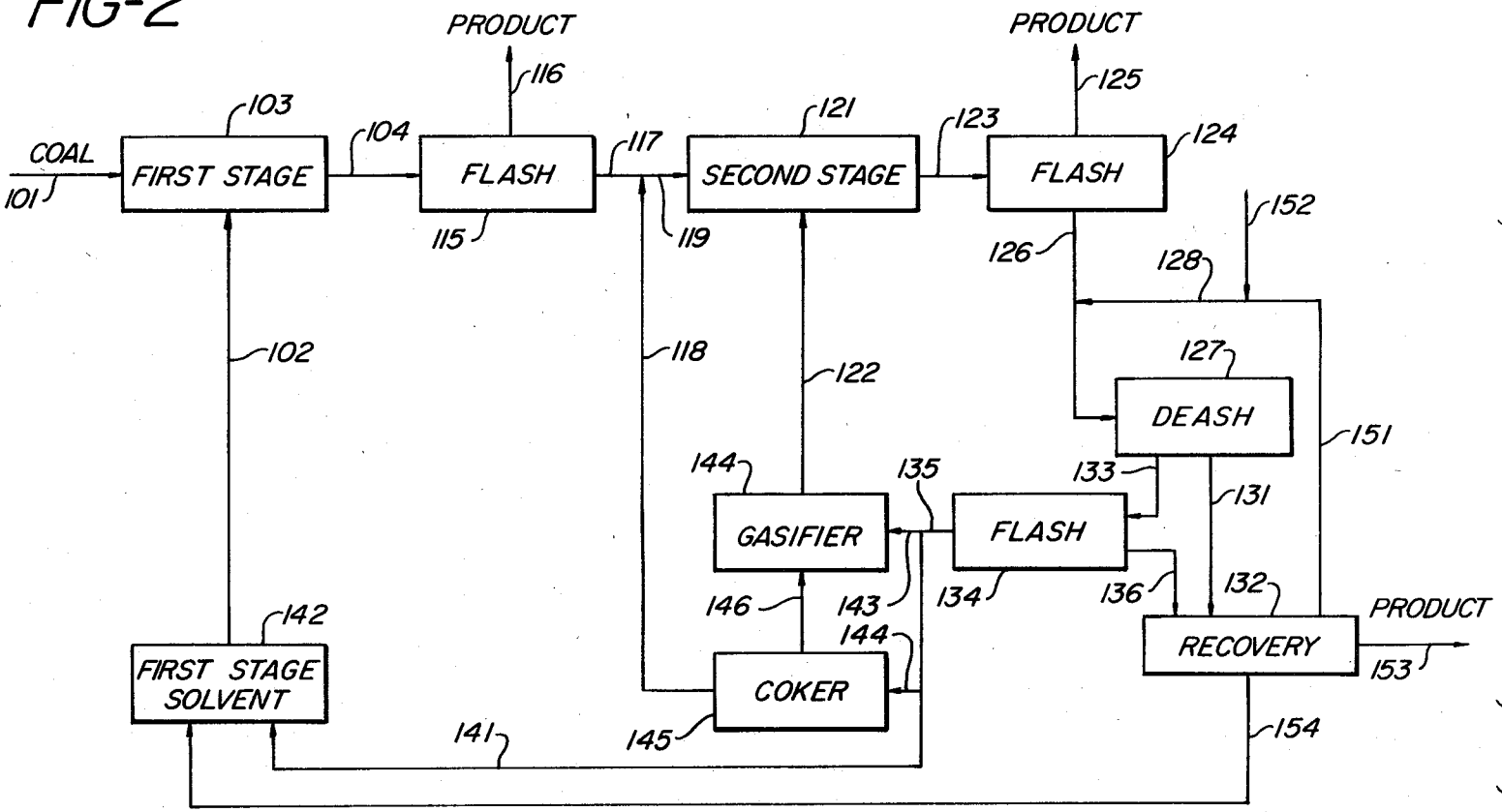

The invention will be further described with respect to an embodiment thereof illustrated in the accompanying drawing, wherein:

FIGS. 1 and 2 are simplified schematic block flow diagrams of embodiments of the invention.

It is to be understood, however, that the scope of the invention is not to be limited to the particularly described embodiments.

Referring now to the drawing, ground pulverized sub-bituminous coal, in line 10, and a coal liquefaction solvent, in line 12, obtained as hereinafter described, are introduced into the first stage liquefaction zone, schematically generally indicated as 13 for effecting a short contact thermal liquefaction of the coal. The thermal liquefaction is effected in the absence of catalyst. The first stage liquefaction is operated at the conditions hereinabove described. The first stage liquefaction generally includes both a heater and a soaker as to increase residence time.

A first stage coal liquefaction product is withdrawn from zone 13 through line 14, and introduced into a flash zone, schematically generally indicated as 15 in order to flash therefrom materials boiling up to about 500° to 600° F. Such flashed materials are removed from flash zone 15 through line 16, as product.

The remainder of the coal liquefaction product, in line 17, is introduced into a deashing zone, schematically generally indicated as 18 for separating ash and other insoluble material from the first stage coal liquefaction product. As particularly described, the deashing in zone 18 is accomplished by use of a promoter liquid for promoting and enhancing the separation of the insoluble material, with such promoter liquid being provided through line 19. In particular, the separation is deashing zone 18 is accomplished in one or more gravity settlers, with the promoter liquid and general procedure for accomplishing such deashing being described, for example, in U.S. Pat. No. 3,856,675.

The essentially ash free overflow is withdrawn from deashing zone 18 through line 22 for introductiuon into a recovery zone, schematically generally indicated as 23.

An underflow containing insoluble material is withdrawn from deashing zone 18 through line 23, and introduced into a flash zone, schematically generally indicated as 24 to flash materials boiling below 850° F. therefrom. The flashing in zone 24 is accomplished in a manner such that there is recovered from flash zone 24, through line 25, a flowable stream containing insoluble material and 850° F.+ liquid. The flashed components are withdrawn from flash zone 24 through line 26 for introduction into the recovery zone 23.

A portion of the 850° F.+ material in line 25 is introduced through line 31 into a first stage solvent storage zone, schematically generally indicated as 32 for formulating the first stage liquefaction solvent, as hereinafter described.

A further portion of the material in line 25 may be used as feedstock in line 61 to a gasifier, schematically indicated at 62, to produce hydrogen.

In addition, a portion of the material in line 25 is introduced through line 63 into a coking zone, schematically indicated as 64, of a type known in the art for conversion to coke.

Coke produced in coking zone 64 is introduced into gasifier 62 through line 65 for producing hydrogen. Products other than coke produced in coking zone 64 are recovered through line 66.

The recovery zone 23 may include one, two or more columns or flash zones which are designed and operated to recover the promoter liquid through line 41 for subsequent introduction into deashing zone 18 through line 19, after addition of make up promoter liquid, as required, through line 42.

The 500° F.+ material which is essentially free of insoluble material is recovered from the recovery zone 23 through line 51 for introduction into a second stage, schematically generally indicated at 52. The hydrogen requirements for the second stage 52 are provided from the gasifier 62 through line 51. Thus, the hydrogen requirements for the second stage are provided by gasification of both underflow in line 61 and coke produced from the underflow in coking zone 64.

In addition, net product, other than coke, produced in coking zone 64 and recovered in line 66 is introduced into the second stage hydrogenation zone 52 for upgrading by hydrogenation. The second stage 52 is operated at temperatures, and conversions, as hereinabove described, preferably with the use of a hydrogenation catalyst of the type hereinabove described.

In accordance with a preferred embodiment, the second stage is in the form of an upflow ebullated bed.

The effluent from the second stage, in line 55, is introduced into a flash zone, schematically generally indicated as 56 to flash therefrom materials boiling below about 850° F. (gases and $C_5$ to 850° F. material), with such lower boiling materials being recovered through line 57 as net product. The flashing is accomplished in a manner such that some 850° F.− material (having an initial boiling point of at least 500° F.) remains with the unflashed material in line 58 for use in formulating liquefaction solvent.

The unflashed material in line 58, which is comprised of all of the 850° F.+ material in the second stage effluent, and some of the 850° F.− material in the second stage effluent (the initial boiling point is generally at least 500° F., and in some case, depending on the pressure used in the first stage, is at least 650° F.) is employed in formulating liquefaction solvent for the first stage.

Thus, the first stage liquefaction solvent is comprised of 850° F.− liquid recovered from the second stage; 850° F.+ liquid recovered from both the first and second stage, as well as insoluble material derived from coal.

Moreover, the hydrogen requirements for the process are provided from the underflow recovered in the deashing zone.

It is to be understood that although the embodiment has been described with reference to providing all of the 850° F.− material used in the liquefaction solvent from the second stage, it is to be understood that depending on process conditions and requirements, a portion of the 850° F.− material used in the first stage liquefaction solvent may be obtained from the first stage; for example, in recovery zone 23. In general, it is preferred that all of the 850° F.− material used in the first stage liquefaction solvent be obtained from second the stage in that such second stage material has improved solvent qualities; i.e., a higher hydrogen to carbon ratio.

As hereinabove indicated, sub-bituminous coal may be liquefied in accordance with the present invention by a procedure in which deashing is accomplished subsequent to the second stage, rather than between the first and second stages.

Referring now to FIG. 2 of the drawings, there is illustrated an embodiment of the present invention wherein deashing is accomplished after the second stage.

Ground pulverized sub-bituminous coal in line 101, and a coal liquefaction solvent, in line 102, obtained as hereinafter described, are introduced into the first stage liquefaction zone, schematically generally indicated as 103 for effecting a short contact thermal liquefaction of the coal. The thermal liquefaction is effected in the absence of catalyst. The first stage liquefaction is operated at the conditions hereinabove described. The first stage liquefaction generally includes both a heater and a soaker so as to increase residence time.

The first stage liquefaction product is withdrawn from zone 103 through line 104, and introduced into a flash zone, schematically generally indicated as 115 in order to flash therefrom materials boiling up to about 500° to 650° F., conditions. Such flashed materials are removed from flash zone 115 through line 116, as a portion of the net product of the process. The remainder of the first stage product, in line 117, is combined with additional materials in line 118, obtained as hereinafter described, and the combined materials in line 119 are introduced into a second stage, schematically generally indicated in 121. The hydrogen requirements for the second stage 121 are provided through line 122, with the source of such hydrogen in line 122 being hereinafter explained.

The second stage 121 is operated at temperatures and conversions, as hereinabove described, preferably with the use of a hydrogenation catalyst of the type hereinabove described.

As should be apparent, the feed to the second stage 121 includes the insoluble material derived from the coal.

Second stage effluent is withdrawn from zone 121 through line 123 and introduced into a flash zone, schematically generally indicated as 124, in order to flash therefrom materials boiling up to about 500° to 650° F. Such flashed materials are removed from flash zone 124 through line 125, as a portion of the net product of the overall process.

The remainder of the product is withdrawn from flash zone 124 through line 126, and introduced into a deashing zone, schematically generally indicated as 127 for separating ash and other insoluble material from the second stage product. As particularly described, the deashing in zone 127 is accomplished by use of a promoter liquid for promoting and enhancing the separation of the insoluble material with such promoter liquid being provided through line 128. In particular, the separation in deashing zone 127 is accomplished in one or more gravity settlers, with the promoter liquid and general procedure for accomplishing such deashing being described, for example, in U.S. Pat. No. 3,856,675.

The essentially ash free overflow is withdrawn from deashing zone 127 through line 131 for formation into a recovery zone, schematically generally indicated as 132.

An underflow containing insoluble material is withdrawn from deashing zone 127 through line 133, and introduced into a flash zone schematically generally indicated as 134 to flash materials boiling below 850° F. therefrom. The flashing in zone 134 is accomplished in a manner such that there is recovered from flash zone 134 through line 135, a flowable stream containing insoluble material and 850° F.+ liquid. The flashed components are withdrawn from flash zone 134 through line 136 for introduction into the recovery zone 132.

A portion of the 850° F.+ material in line 135 is introduced through line 141 into a first stage solvent storage zone, schematically generally indicated as 142 for formulating the first stage liquefaction solvent, as hereinafter described.

A further portion of the material in line 135 may be used as feedstock in line 143 to a gasifier, schematically generally indicated at 144 to produce hydrogen.

In addition, a portion of the material in line 135 is introduced through line 144 into a coking zone, schematically generally indicated as 145, of a type known in the art for conversion to coke.

Coke produced in coking zone 145 is introduced into gasifier 144 through line 146 for producing hydrogen. Products other than coke produced in coking zone 144 are recovered through line 118 for further treatment and/or upgrading in the second stage 121.

The recovery zone 132 may include one, two or more columns or if flash zones which are designed and operated to recover the promoter liquid through line 151 for subsequent introduction into the deashing zone 127 through line 128, after addition of make up promoter liquid, as required through line 152.

In addition, net product is recovered through line 153, with such net product being comprised of gas and $C_5$ to 850° F. material recovered from the second stage effluent.

Material for formulating first stage liquefaction solvent is recovered from the recovery zone 132 through line 154, and such material is comprised of all of the 850° F.+ material in the second stage effluent, and some of the 850° F.− material in the second stage effluent (the initial boiling point is generally at least 500° F., in some cases, depending on the pressure used in the first stage, is at least 650° F.) and such material, in line 154, is employed in formulating liquefaction solvent for the first stage.

Thus, the first stage liquefaction solvent is comprised of 850° F.− liquid recovered from the second stage, as well as 850° F.+ liquid recovered from the second stage, and insoluble material derived from the coal, which insoluble material is separated from the effluent subsequent to the second stage.

Moreover, as hereinabove described with respect to the embodiment of FIG. 1, the hydrogen requirements for the process are provided from the underflow recovered in the deashing zone.

Thus, as should be apparent, the present invention is applicable to liquefying sub-bituminous coal in two stages wherein deashing may be accomplished subsequent to the first stage or subsequent to the second stage.

Although the invention has been described with respect to a particular embodiment, it is to be understood that the invention is not limited to such embodiment. Thus, for example, the deashing may be accomplished other than as particularly described. Similarly, the second stage may be accomplished other than as particularly described; i.e., other than by use of an upflow ebullated bed.

As a further modification, gaseous hydrogen may be introduced into the first stage even though gaseous hydrogen consumption in the first stage is low, generally less than 1% by weight, and as low as no hydrogen consumption.

These modifications and others should be apparent to those skilled in the art from the teachings herein.

The present invention will be further described with respect to the following example:

EXAMPLE

Sub-bituminous coal is liquefied by a two stage process in accordance with the FIG. 1 embodiment of the invention.

The coal is Wyodak coal having the analysis of Table 1.

The first stage is operated without the addition of gaseous hydrogen at the conditions of Table 2. The feed is 36% coal and 64% liquefaction solvent. The liquefaction solvent is comprised of 20% deasher underflow and 80% of materials derived from the second stage. The characteristics of the liquefaction solvent are reported in Table 3.

3.65 lbs. of gaseous hydrogen per 100 lbs. of coal feed to the process is introduced into the second stage. The second stage is operated at the conditions reported in Table 4. Such hydrogen is produced in the gasifier from deasher underflow and coke produced in the coking zone.

Overall gaseous hydrogen consumption is 2.1 weight percent of the coal feed, and the total yield for the process, per 100 lb. of coal feed, is reported in Table 5. The total underflow reported in Table 5 represents coke and deashing underflow introduced as feed to the gasifier.

TABLE 1

| COAL ANALYSES | Wyodak |
|---|---|
| Proximate Analysis | |
| Moisture Content | 7.80 |
| Volatile Matter (Dry Basis) | 46.10 |
| Ash Content (Dry Basis) | 10.20 |
| Fixed Carbon (Dry Basis) | 43.70 |
| Ultimate Analysis (MF Basis) | |
| Carbon Content | 66.16 |
| Hydrogen Content | 4.61 |
| Sulfer content | 0.78 |
| Nitrogen Content | 0.98 |
| Oxygen Content (By Diff.) | 17.27 |
| Ash Content | 10.20 |
| H/C Atomic Ratio | 0.84 |

TABLE 2

| Feed Coal | Wyodak Coal |
|---|---|
| Coal Concentration, Wt. % | 36 |
| Preheater Outlet Temperature, °F. | 840 |
| Soaker Temperature, °F. | 840 |
| Reactor Pressure, PSIG | 2,000 |
| Coal Space Rate, lb/hr-ft$^3$ | 76 |
| Gas Rate, SCF/Ton MF Coal | 13,500 |

TABLE 3

| Recycle Solvent Composition | Wt. % |
|---|---|
| IBP-500° F. | 1.8 |
| 500-650° F. | 9.1 |
| 650-850° F. | 53.8 |
| 850° F. | 35.3 |
| % Preasphaltenes | 4.3 |
| % Asphaltenes | 3.7 |
| % Solids (Q1) | 6.7 |
| % Ash | 3.4 |

TABLE 4

| SECOND STAGE | |
|---|---|
| Maximum Reactor Temperature, °F. | 700 |
| Averge Reactor Temperature, °F. | 680 |
| System Pressure, PSIG | 2,700 |
| Space Rate, Vol, Feed/hr-Vol. Catalyst | 0.82 |

TABLE 5

| INTEGRATED TWO STAGE LIQUEFACTION YIELDS YIELDS, LB/100 LB MF COAL | |
|---|---|
| $H_2S$, $H_2O$, $NH_3$, $CO_x$ | 20.58 |
| $C_1$-$C_4$ | 6.40 |
| Total Gas | 26.98 |
| $C_5$/390° F. | 1.12 |
| 390/500° F. | 7.48 |
| 500/650° F. | 19.31 |
| 650/850° F. | 17.72 |
| Total Distillate Product | 45.63 |
| Total Underflow | 31.04 |
| Grand Total | 103.65 |

The present invention is particularly advantageous in that sub-bituminous coal can be directly liquefied at high hydrogen selectivity to distillates ($C_5$ to 850° F.), and at low gas yield. In particular, it has unexpectedly been found that the hydrogen consumption in the second stage in the present process for the direct liquefaction of sub-bituminous coal is lower than second stage hydrogen consumption in a direct liquefaction process using bituminous coal as feed.

The use of hydrogen is sufficiently efficient that the portion of the deashing underflow which is not used in producing liquefaction solvent, is present in an amount that a portion thereof may be used in a coking operation, as well as in gasification for producing hydrogen. Thus, the process is in hydrogen balance and there is no need to separately hydrogenate recycle solvent.

These and other advantages should be apparent to those skilled in the art from the teachings herein.

Numerous modifications and variations of the present inventiuon are possible in light of the above teachings and, therefore, within the scope of the appended claims, the invention may be practiced otherwise than as particularly described.

What is claimed is:

1. A process for the liquefaction of sub-bituminous coal, comprising:

contacting sub-bituminous coal with a liquefaction solvent in a first stage thermal liquefaction zone; hydrogenating first stage product in a second stage with a gaseous hydrogen, said second stage being operated at a temperature of no greater than 700° F.; recovering from the second stage a first stream of 850° F.− material, as net liquefaction product, and a second stream of a mixture of 850° F.− material and 850° F.+ material; recovering a pumpable stream of insoluble material in 850° F.+ material from one of the first and second stage; and employing the pumpable stream and second stream for formulating liquefaction solvent for the first stage consisting essentially of from 5% to 10%, by weight, of insoluble material provided from one of the first and second stages, at least 45%, by weight, of 850° F.− material provided from the second stage without further hydrogenation, 0% to 20%, by weight, of 850° F.− material provided from the first stage without further hydrogenation, and the remainder of said liquefaction solvent being 850° F.+ material, said 850° F.+ material of the liquefaction solvent being provided in an amount of at least 20%, by weight, from the second stage without further hydrogenation and any remainder of the 850° F.+ material of the liquefaction solvent being provided from the first stage without further hydrogenation.

2. The process of claim 1 wherein all of the 850° F.+ material from the second stage is employed in formulating liquefaction solvent.

3. The process of claim 1 wherein the second stage temperature is at least 650° F.

4. The process of claim 3 wherein the first stage temperature is from 800° F. to 875° F.

5. The process of claim 4 wherein there is essentially no gaseous hydrogen consumption in the first stage.

6. The process of claim 5 wherein the ratio of solvent to coal is from 1.2:1 to 3:1.

7. The process of claim 6 wherein insoluble material is separated from first stage product prior to hydrogenation in the second stage.

8. The process of claim 7 wherein the second stage hydrogenation is effected in an ebullated bed of catalyst.

9. The process of claim 1 wherein insoluble material is recovered from first stage product, prior to the second stage, as a pumpable stream in 850° F.+ material, and said insoluble material for said liquefaction solvent is provided as a pumpable stream.

10. The process of claim 9 wherein all of the 850° F.+ material employed in the liquefaction solvent, other than 850° F.+ material included in the pumpable stream, is provided from the second stage.

11. The process of claim 10 wherein the second stage temperature is at least 650° F.

12. The process of claim 1 wherein insoluble material is separated from second stage product as a pumpable stream in 850° F.+ material, and insoluble material is provided for the liquefaction solvent as a pumpable stream.

13. The process of claim 12 wherein a portion of the recovered pumpable stream is employed for generating hydrogen.

14. A process for the liquefaction of sub-bituminous coal, comprising:

contacting sub-bituminous coal with a liquefaction solvent in a first stage thermal liquefaction zone; separately recovering from the first stage liquefaction a pumpable stream of insoluble material in 850° F.+ material, 850° F.− material and a mixture of 850° F.+ material and 850° F.− material which is essentially free of insoluble material; hydrogenating said mixture in a second stage with gaseous hydrogen at a temperature of from 650° F. to 700° F.; recovering 850° F.− material as net product from the second stage; recovering another mixture of 850° F.− material and 850° F.+ material from the second stage; and providing, without further hydrogenation, liquefaction solvent for the first stage consisting essentially of the pumpable stream, the 850° F.− material from the first stage and said another mixture, said another mixture providing at least 45%, by weight, of 850° F.− material for the liquefaction solvent, said 850° F.− material from the first stage providing from 5% to 15%, by weight, of the 850° F.− material of the liquefaction solvent, said pumpable stream providing from 5% to 10%, by weight, of insoluble material in the liquefaction solvent, and the remainder of the liquefaction solvent being 850° F.+ material provided from the pumpable stream and the another mixture, with at least 20%, by weight, of the 850° F.+ material in the liquefaction solvent being provided by the another mixture.

15. The process of claim 14 wherein said first stage is operated with essentially no gaseous hydrogen consumption.

16. The process of claim 15 wherein the first stage is operated at a temperature of 800° F. to 875° F.

17. The process of claim 15 wherein the second stage is effected in an ebullated bed of catalyst.

* * * * *